US008047191B2

(12) United States Patent
Christopher et al.

(10) Patent No.: US 8,047,191 B2
(45) **Date of Patent: *Nov. 1, 2011**

(54) MECHANICAL DRIVE ASSIST FOR ACTIVE FEED PAINTBALL LOADER

(75) Inventors: James T. Christopher, Sachse, TX (US); Albert G. Schilling, Garland, TX (US); Chris T. Goddard, Lewisville, TX (US)

(73) Assignee: KEE Action Sports I LLC, Sewell, NJ (US)

( * ) Notice: Subject to any disclaimer, the term of this patent is extended or adjusted under 35 U.S.C. 154(b) by 14 days.

This patent is subject to a terminal disclaimer.

(21) Appl. No.: 12/050,229

(22) Filed: Mar. 18, 2008

(65) Prior Publication Data

US 2008/0216805 A1 Sep. 11, 2008

Related U.S. Application Data

(63) Continuation of application No. 11/116,595, filed on Apr. 28, 2005, now Pat. No. 7,343,909.

(60) Provisional application No. 60/566,381, filed on Apr. 28, 2004.

(51) Int. Cl.
*F41B 11/02* (2006.01)

(52) U.S. Cl. ..... 124/51.1

(58) Field of Classification Search ..... 124/45, 124/48, 49, 51.1, 73, 74

See application file for complete search history.

(56) References Cited

U.S. PATENT DOCUMENTS

| | | | |
|---|---|---|---|
| 1,403,689 | A | 1/1922 | Hyndman |
| 1,403,719 | A | 1/1922 | Szepe |
| 1,404,689 | A | 1/1922 | Fairweather |
| 1,743,576 | A | 1/1930 | Bigham |
| 1,867,513 | A | 7/1932 | Johannes |
| 1,954,093 | A | 4/1934 | Nelson |
| 2,307,015 | A | 1/1943 | Boynton |
| 2,357,951 | A | 9/1944 | Hale |

(Continued)

FOREIGN PATENT DOCUMENTS

| | | |
|---|---|---|
| DE | 876370 | 5/1953 |

(Continued)

OTHER PUBLICATIONS

WARPIG—World And Regional Paintball Information Guide, http://www.warpig.com/paintball/technical/loaders/halo/index.shtml, WARPIG.COM, Odyssey Readies Halo for Production, by Bill Mills, Jun. 2001, pp. 1 to 5.

(Continued)

*Primary Examiner* — John Ricci
(74) *Attorney, Agent, or Firm* — Volpe and Koenig, P.C.

(57) ABSTRACT

An active feed paintball loader for supplying paintballs to a paintball marker. The loader includes a container for storing a plurality of paintballs. An outfeed tube on the container is connected to an inlet tube on the marker. The loader further includes a drive shaft, a feeder rotatably disposed in the container for feeding paintballs into the outfeed tube, and a drive spring having first and second ends. The first end is engaged to the feeder to provide a driving force to rotate the feeder within the container. The second end is coupled to the drive shaft. The drive shaft operates to wind the drive spring to maintain sufficient tension on the drive spring to maintain a paintball stack in the outfeed tube. The loader further includes a mechanical drive handle accessible externally of the loader and connected to the drive shaft to manually wind the drive spring.

12 Claims, 9 Drawing Sheets

U.S. PATENT DOCUMENTS 2,398,263 A 4/1946 Trimbach
2,639,904 A 5/1953 McMaster
3,248,008 A 4/1966 Meierjohan
3,467,073 A 9/1969 Rhodes
3,610,223 A 10/1971 Green
3,695,246 A 10/1972 Filippi et al.
3,788,298 A 1/1974 Hale
3,789,891 A 2/1974 Bosch
3,844,267 A 10/1974 Mohr
3,855,988 A 12/1974 Sweeton
3,867,921 A 2/1975 Politzer
4,027,646 A 6/1977 Sweeton
4,185,824 A 1/1980 Natwick
4,207,857 A 6/1980 Balka, Jr.
4,332,097 A 6/1982 Yatlor, Jr.
4,646,709 A 3/1987 Kholin
4,745,842 A 5/1988 Shou-Fu
4,759,435 A 7/1988 Cedrone
4,819,609 A 4/1989 Tippmann
4,850,330 A 7/1989 Nagayoshi
4,896,646 A 1/1990 Kahelin et al.
4,926,742 A 5/1990 Ma et al.
4,930,400 A 6/1990 Brandl et al.
4,936,282 A 6/1990 Dobbins et al.
4,951,548 A 8/1990 Wixon et al.
4,951,644 A 8/1990 Bon
4,965,951 A 10/1990 Miller et al.
4,986,251 A 1/1991 Lilley
4,993,400 A 2/1991 Fitzwater
5,063,905 A 11/1991 Farrell
5,097,816 A 3/1992 Miller
5,097,985 A 3/1992 Jones
5,166,457 A 11/1992 Lorenzetti
5,282,454 A 2/1994 Bell et al.
5,335,579 A 8/1994 David
5,353,712 A 10/1994 Olsen
5,361,746 A 11/1994 Szente
5,383,442 A 1/1995 Tippmann
5,456,153 A 10/1995 Bentley et al.
5,490,493 A 2/1996 Salansky
5,497,758 A 3/1996 Dobbins et al.
5,505,188 A 4/1996 Williams
5,511,333 A 4/1996 Farrell
5,520,171 A 5/1996 David
5,542,570 A 8/1996 Nottingham et al.
5,561,258 A 10/1996 Bentley et al.
5,600,083 A 2/1997 Bentley et al.
5,722,383 A 3/1998 Tippmann
5,727,538 A 3/1998 Ellis
5,736,720 A 4/1998 Bell et al.
5,749,797 A 5/1998 Sunseri et al.
5,771,875 A 6/1998 Sullivan
5,784,985 A 7/1998 Lodico et al.
5,791,325 A 8/1998 Anderson
5,794,606 A 8/1998 Deak
5,809,983 A 9/1998 Stoneking
5,816,232 A 10/1998 Bell
5,839,422 A 11/1998 Ferris
5,881,962 A 3/1999 Schmidt et al.
5,887,578 A 3/1999 Backeris et al.
5,947,100 A 9/1999 Anderson
5,954,042 A 9/1999 Harvey
6,032,395 A 3/2000 Bentley et al.
6,055,975 A 5/2000 Gallagher et al.
6,109,252 A 8/2000 Stevens
6,206,562 B1 3/2001 Eyraud et al.
6,213,110 B1 4/2001 Christopher et al.
6,220,237 B1 4/2001 Johnson et al.
6,305,367 B1 10/2001 Kotsiopoulos
6,327,953 B1 12/2001 Andresen
6,347,621 B1 2/2002 Guthrie
6,374,819 B1 4/2002 Ming-Hsien
6,408,836 B1 6/2002 Ming Hsien
6,408,837 B1 6/2002 Johnson et al.
D459,767 S 7/2002 Rushton
6,415,781 B1 7/2002 Perrone
6,418,919 B1 7/2002 Perrone
6,425,781 B1 7/2002 Bernstein et al.
6,460,530 B1 10/2002 Backeris et al.
6,467,473 B1 10/2002 Kotsiopoulos
6,468,879 B1 10/2002 Lamure et al.
6,481,432 B2 11/2002 Rushton et al.
6,488,019 B2 12/2002 Kotsiopoulos
6,502,567 B1 1/2003 Christopher et al.
6,520,854 B1 2/2003 McNally
6,526,955 B1 3/2003 Juan
6,588,412 B2 7/2003 Ferrara et al.
6,591,824 B2 7/2003 Hatcher
6,609,511 B2 8/2003 Kotsiopoulos
6,615,814 B1 9/2003 Rice et al.
6,644,293 B2 11/2003 Jong
6,684,873 B1 2/2004 Anderson
6,701,907 B2 3/2004 Christopher et al.
6,708,685 B2 3/2004 Masse
6,725,852 B1 4/2004 Yokota et al.
6,729,321 B2 5/2004 Ho
6,729,497 B2 5/2004 Rice et al.
6,739,322 B2 5/2004 Rice et al.
6,739,323 B2 5/2004 Tippmann, Jr.
6,742,512 B1 6/2004 Ho
6,752,137 B2 6/2004 Brunette
6,792,933 B2 9/2004 Christopher et al.
6,802,306 B1 10/2004 Rice
6,860,258 B2 3/2005 Farrell
6,889,680 B2 5/2005 Christopher et al.
6,915,792 B1 7/2005 Sheng
6,978,776 B2 12/2005 Hamilton
6,981,493 B1 1/2006 Poterack
7,017,569 B2 3/2006 Jong
7,021,302 B2 4/2006 Neumaster
7,077,118 B2 7/2006 Lewis
D535,339 S 1/2007 Broersma
7,159,585 B2 1/2007 Quinn et al.
7,222,617 B2 5/2007 Andresen
D544,047 S 6/2007 Bell et al.
7,234,456 B2 6/2007 Andresen
7,270,121 B2 9/2007 Lubben
7,343,909 B2 * 3/2008 Christopher et al. ..... 124/51.1
D567,302 S 4/2008 Choi
D567,303 S 4/2008 Neumaster
7,441,556 B2 10/2008 Friesen et al.
7,445,002 B2 11/2008 Christopher et al.
7,568,478 B2 8/2009 Hedberg
7,654,255 B2 2/2010 Spicer
7,694,669 B2 4/2010 Campo
7,832,389 B2 11/2010 Christopher
7,841,328 B2 11/2010 Italia et al.
2002/0014230 A1 2/2002 Christopher et al.
2002/0020402 A1 2/2002 Kotsiopoulos
2002/0059927 A1 5/2002 Woods
2002/0092513 A1 7/2002 Christopher et al.
2002/0117159 A1 8/2002 Kotsiopoulos et al.
2003/0047173 A1 3/2003 Juan
2003/0079731 A1 5/2003 Dobbins
2003/0127084 A1 7/2003 Tippmann, Jr.
2004/0074487 A1 4/2004 Christopher et al.
2004/0074489 A1 4/2004 Neumaster et al.
2004/0112356 A1 6/2004 Hatcher
2004/0194772 A1 10/2004 Hamilton
2004/0211402 A1 10/2004 Christopher et al.
2004/0245276 A1 12/2004 Hashimoto et al.
2005/0028801 A1 2/2005 Lewis
2005/0121015 A1 6/2005 Postorivo, Jr.
2005/0188974 A1 9/2005 Pedicini et al.
2005/0241628 A1 11/2005 Hatcher
2005/0274370 A1 12/2005 Lubben
2005/0284456 A1 12/2005 Chipley
2005/0284457 A1 12/2005 Hatcher
2006/0005823 A1 1/2006 Quinn
2006/0032488 A1 2/2006 Telford
2006/0037597 A1 2/2006 Wood
2006/0054151 A1 3/2006 Christopher et al.
2006/0081233 A1 4/2006 Andresen
2006/0081234 A1 4/2006 Andresen
2006/0086347 A1 4/2006 Hedberg
2006/0124118 A1 6/2006 Dobbins
2006/0157040 A1 7/2006 Broersma et al.

| | | | |
|---|---|---|---|
| 2006/0196489 | A1 | 9/2006 | Campo |
| 2006/0249131 | A1 | 11/2006 | Broersma |
| 2006/0254572 | A1 | 11/2006 | Hall |
| 2007/0017495 | A1 | 1/2007 | Andresen |
| 2007/0023025 | A1 | 2/2007 | Neumaster et al. |
| 2007/0056573 | A1 | 3/2007 | Campo |
| 2007/0062506 | A1 | 3/2007 | Bell |
| 2007/0083420 | A1 | 4/2007 | Andresen et al. |
| 2007/0101981 | A1 | 5/2007 | Chen |
| 2007/0113834 | A1 | 5/2007 | Spicer |
| 2007/0137631 | A1 | 6/2007 | Christopher |
| 2008/0047536 | A1 | 2/2008 | Chen |
| 2008/0047537 | A1 | 2/2008 | Kulp et al. |
| 2008/0141990 | A1 | 6/2008 | Andresen |
| 2008/0178859 | A1 | 7/2008 | Moore et al. |
| 2009/0000608 | A1 | 1/2009 | Christopher et al. |
| 2009/0025700 | A1 | 1/2009 | Andresen |
| 2009/0133680 | A1 | 5/2009 | Christopher et al. |

FOREIGN PATENT DOCUMENTS

| | | |
|---|---|---|
| DE | 2035097 | 8/1982 |
| DE | 3721527 | 1/1989 |
| DE | 4343870 | 6/1994 |
| DE | 4343871 | 6/1995 |
| DE | 19922589 | 12/2000 |
| EP | 0075970 | 4/1983 |
| EP | 01054228 | 11/2000 |
| EP | 01653189 | 5/2006 |
| FR | 921527 | 5/1947 |
| GB | 470201 | 8/1937 |
| GB | 551077 | 2/1943 |
| GB | 2322438 | 8/1998 |
| JP | 1179898 | 7/1989 |
| JP | 6325233 | 11/1994 |
| TW | M. 255391 | 1/2005 |
| WO | 98/13660 | 4/1998 |
| WO | 01/44745 | 6/2001 |
| WO | 02/42708 | 5/2002 |
| WO | 03087698 | 10/2003 |
| WO | 2007/035601 | 3/2007 |
| WO | 2007033309 | 3/2007 |
| WO | 2007044546 | 4/2007 |
| WO | 2007044822 | 4/2007 |
| WO | 2008104061 | 4/2008 |

OTHER PUBLICATIONS

WARPIG—World And Regional Paintball Information Guide, http://www.warpig.com/paintball/technical/loaders/halo/review.shtml, WARPIG.COM, Odyssey Halo By Bill Mills, Dec. 2001, pp. 1 to 7.

Odyssey Halo B Paintball Hopper Review, http://www.paintball-gun-review.com/hopper-reviews/odyssey-halo-b..., Paintball Gun Review, Odyssey Halo B Paintball Hopper Review, 2004 Paintball-Gun-Review.com, pp. 1-4.

www.Odysseypaintball.com, http://web.archive.org/web/20030205112543/http://www.odysseypain..., Odyssey Paintball Products, Understanding Halo B, pp. 1-3.

Warpig—World and Regional Paintball Information Guide, http://www.warpig.com/paintball/technical/loaders/evlution/evlution . . . eVLution 2 Sneak Preview, by Bill Mills, Aug. 2001, pp. 1 to 4.

Warpig—World and Regional Paintball Information Guide, http://www.warpig.com/paintball/technical/loaders/evlution/index.shtml Brass Eagle's eVLution Loader, by Bill Mills, Aug. 2000, pp. 1 to 7.

Warpig—World and Regional Paintball Information Guide, http://www.warpig.com/paintball/technical/labs/revytimes/index/shtmI WARPIG Ballistic Labs Report: Revolution Response Times, by Bill Mills, copyright 1992-2010, pp. 1 to 4.

* cited by examiner

MECHANICAL DRIVE ASSIST FOR ACTIVE FEED PAINTBALL LOADER

CROSS REFERENCE TO RELATED APPLICATION

This application claims the benefit of U.S. application Ser. No. 11/116,595, filed on Apr. 28, 2005, which claims the benefit of U.S. Provisional Application No. 60/566,381, filed on Apr. 28, 2004, which are incorporated herein by reference as if fully set forth.

FIELD OF INVENTION

The present invention relates to paintball loaders, and more particularly to an externally mounted, manually operated handle connected to an extended drive shaft of an active feed paintball loader.

BACKGROUND

Agitating paintball loaders are well known in the art of paintball sports, and operate by having a paintball agitator advance balls from the bottom of a loader into an outfeed tube. One problem with convention agitators is that a jam can occur, such as when a paintball becomes lodged in the agitator or feeder. In order to clear the jam, the paintball sport player must shake the loader.

Active or force feeding paintball loaders are technologically advanced loaders that use battery-operated motors to forcibly drive paintballs from the loader, into an outfeed tube, and into the breech of a paintball marker. Examples of such loaders can be found in U.S. Pat. Nos. 6,213,110, 6,502,567, 6,701,907, and 6,792,933, the entire disclosures of which are incorporated by reference herein. As paintball loaders have evolved into electronically controlled devices capable of actively or forcibly feeding paintballs into a paintball gun, there has arisen a need for the loader to employ a mechanical backup system if a jam occurs.

Thus, there has arisen the need for a device that includes a mechanism for allowing the user to manually manipulate the motor driven system of an active feed paintball loader to clear paintball jams.

SUMMARY

One aspect of the present invention is directed to a drive assist mechanism for use with an active feed paintball loader. The drive assist mechanism comprises a drive shaft longitudinally positioned along a center axis and rotatable about the center axis. A drive member is mounted on the drive shaft and rotatable about the center axis in coordination with the drive shaft. A feeder is secured to the drive shaft and independently rotatable about the center axis relative to the drive member. A spring is located between the drive member and the feeder and adapted to maintain constant tension on the feeder when the drive shaft rotates in a feeding direction. A manual drive handle is secured to the drive shaft and extends externally from the loader. The manual drive handle is rotatable about the center axis in coordination with the drive shaft.

Another aspect of the present invention is directed toward a drive assist mechanism for use on an active feed paintball loader. The drive assist comprises an axial member rotatably positioned about a center axis. A first spool is mounted on the axial member and rotatable about the center axis in coordination with the axial member. The first spool includes a pressure wall. A second spool is secured to the axial member and independently rotatable about the center axis relative to the first spool. The second spool has a retaining wall. The drive assist further comprises a spring having a first end engaged to the pressure wall and a second end engaged to the retaining wall. The spring is adapted to wind when the first spool is rotated about the second spool. A manual drive handle is provided to be fixedly secured to the axial member and extends to a position external to the loader. The manual drive handle is rotatable about the center axis in coordination with the axial member.

Another aspect of the present invention is directed toward an active feed paintball loader for use on a paintball marker. The active feed paintball loader comprises a loader housing for holding a plurality of paintballs and a drive assist mechanism for feeding paintballs into an inlet of a chamber of the marker. The drive assist mechanism further comprises a drive shaft longitudinally positioned along a center axis and rotatable about the center axis, a feeder independently rotatable about the center axis relative to the drive shaft, a spring having a first end engaged to the drive shaft and a second end engaged to the feeder, the spring being adapted to maintain constant tension on the feeder when the drive shaft rotates about the center axis in a feeding direction, and a manual drive handle secured to the drive shaft and positioned to extend externally from the loader housing. The manual drive handle is rotatable about the center axis in coordination with the drive shaft.

Another aspect of the present invention is directed to a manual agitator for an active feed paintball loader. The manual agitator comprises a drive shaft longitudinally positioned along a center axis and rotatable about the center axis. A drive member is mounted on the drive shaft and rotatable about the center axis in coordination with the drive shaft. A feeder is secured to the drive shaft and independently rotatable about the center axis relative to the drive member. A manual drive handle is secured to the drive shaft and positioned to extend externally from the loader. The manual drive handle is rotatable about the center axis in coordination with the drive shaft.

Another aspect of the present invention is directed to an active feed paintball loader for actively maintaining a paintball stack. The active feed paintball loader comprises a feeder, a drive shaft, a motor in communication with the drive shaft for rotating the drive shaft in a feeding direction, a spring positioned between the drive shaft and the feeder, the drive shaft winding the spring to maintain sufficient tension on the spring for maintaining the paintball stack, and a drive assist mechanism comprising a mechanical drive handle positioned adjacent an outer wall of the loader and accessible externally of the loader. The mechanical drive handle adapted to manually rotate the drive shaft.

Another aspect of the present invention is directed to an active feed paintball loader for supplying paintballs to a paintball marker. The active feed paintball loader comprises a container for storing a plurality of paintballs, the container having an outfeed tube. A feeder is rotatably disposed in the container for feeding the paintballs into the outfeed tube. A motor is provided for rotating the feeder. A drive spring is provided having a first end and a second end. The first end of the drive spring is engaged to the feeder to provide a driving force to rotate the feeder within the container. The second end of the drive spring is coupled to the motor. The motor operates to wind the drive spring to maintain sufficient tension on the drive spring to maintain a paintball stack in the outfeed tube. A mechanical drive handle is further provided to be positioned adjacent an outer wall of the loader and accessible externally of the loader. The mechanical drive handle is adapted to manually wind the drive spring.

Another aspect of the present invention is directed to an active feed paintball loader for use on a paintball marker. The active feed paintball loader comprises a loader housing for holding a plurality of paintballs and a drive assist mechanism for feeding paintballs into an inlet of a chamber of the marker. The drive assist mechanism further comprises a drive shaft longitudinally positioned along a center axis and rotatable about the center axis, a drive cone secured to the drive shaft and independently rotatable about the center axis relative to the drive shaft, the drive cone providing a support beneath the paintballs, a spring having a first end engaged to the drive shaft and a second end engaged to the drive cone, the spring adapted to maintain constant tension on the drive cone when the drive shaft rotates about the center axis in a feeding direction, and a manual drive handle secured to the drive shaft and positioned to extend externally from the loader housing. The manual drive handle is rotatable about the center axis in coordination with the drive shaft.

Another aspect of the present invention is directed to an active feed paintball loader for actively maintaining a paintball stack. The active feed paintball loader comprises a drive shaft, a feeder rotatable about the drive shaft and providing support beneath at least one paintball in the paintball stack, and a motor in communication with the drive shaft for rotating the drive shaft in a feeding direction. The motor is coupled to a microprocessor to control operation of the motor. The active feed paintball loader further comprises a spring positioned between the drive shaft and the feeder. The drive shaft is adapted to wind the spring to maintain sufficient tension on the spring for maintaining the paintball stack. A drive assist mechanism is further provided manually rotate the drive shaft. The drive assist mechanism comprises a mechanical drive handle positioned adjacent an outer wall of the loader and accessible externally of the loader.

BRIEF DESCRIPTION OF THE DRAWINGS

The foregoing summary, as well as the following detailed description of preferred embodiments of the invention, will be better understood when read in conjunction with the appended drawings. In the drawings.

DETAILED DESCRIPTION OF THE PREFERRED EMBODIMENTS

Certain terminology is used in the following description for convenience only and is not limiting. The words "top," "bottom," "side," "front," "rear," "central," "upper," and "lower" designate positions in the attached drawings. The words "inwardly" and "outwardly" refer to directions toward and away from, respectively, the geometric center of the loader and designated parts thereof.

With reference to FIGS. 1-10, wherein like numerals indicate like elements throughout, preferred embodiments of the invention will be described below.

Figure 1:
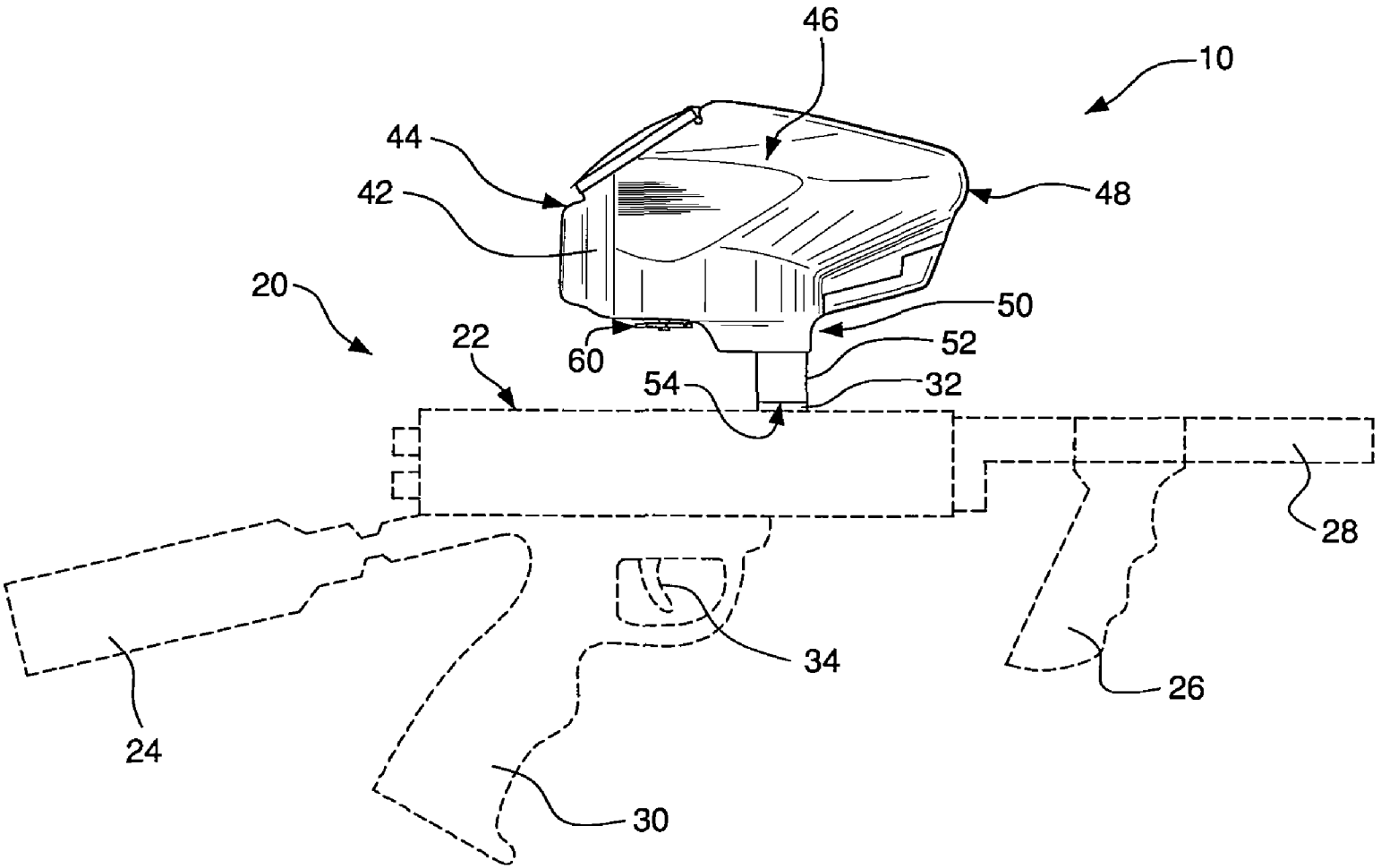
FIG. 1 is a side elevational view of an active feed paintball loader constructed in accordance with the teachings of the present invention and operatively attached to a paintball marker illustrated in phantom.

FIG. 1 is a side elevational view of an active feed paintball loader 10 constructed in accordance with the teachings of the present invention and operatively attached to a representative paintball marker 20, illustrated in phantom. The paintball marker 20 includes a main body 22, a compressed gas cylinder 24, a front handgrip 26, a barrel 28, and a rear handgrip 30. The paintball marker 20 also includes an inlet tube 32 leading to a firing chamber (not shown) in the interior of the main body and a trigger 34. The front handgrip 26 projects downwardly from the barrel 28 and provides an area for gripping by an operator of the paintball marker 20. The compressed gas cylinder 24 is typically secured to a rear portion of the paintball marker 20. The compressed gas cylinder 24 normally contains $CO_2$, although any compressible gas may be used.

In operating the paintball marker 20, the trigger 34 is squeezed, thereby actuating the compressed gas cylinder 24 to release bursts of compressed gas. The bursts of gas are used to eject paintballs outwardly through the barrel 28. The paintballs are continually fed by the paintball loader 10 through the inlet tube 32 to the firing chamber. Although FIG. 1 depicts an automatic paintball marker 20, the paintball marker 20 may also be a semi-automatic marker.

Active feed paintball loaders are described in detail in U.S. Pat. No. 6,213,110 ("'Rapid Feed Paintball Loader"), U.S. Pat. No. 6,502,567 ("'Rapid Feed Paintball Loader With Pivotable Deflector"), U.S. Pat. No. 6,701,907 ("Spring Loaded Feed Mechanism For Paintball Loader"), and U.S. Pat. No. 6,792,933 (Drive Cone For Paintball Loader), the entire contents of which are each incorporated herein by reference. The active feed paintball loader 10 includes a paintball container 42 having a container wall 44 forming an interior area 46. The container 42 may be divided into an upper portion 48 and a lower portion 50. Generally, an exit tube 52 leads from the lower portion 50 of the container 42 to an outlet opening 54, although the exit tube 52 may be positioned at another location in the container 42. The exit tube 52 is positioned adjacent the inlet tube 32 of the paintball marker 20. Referring to FIGS. 2-5, a feed mechanism 56 is used to drive or urge the paintballs toward the exit tube 52 and into the inlet tube 32.

The feed mechanism 56 is coupled to a motor 58 to drive paintballs toward the exit tube 52, or a manual drive assist mechanism 60 can be used to drive the feed mechanism 56, as described in greater detail below. The manual drive assist mechanism 60 extends from the lower portion 50 of the container 42 and includes a manually operated handle 62 connected to an extended drive shaft 64.

Figure 3:
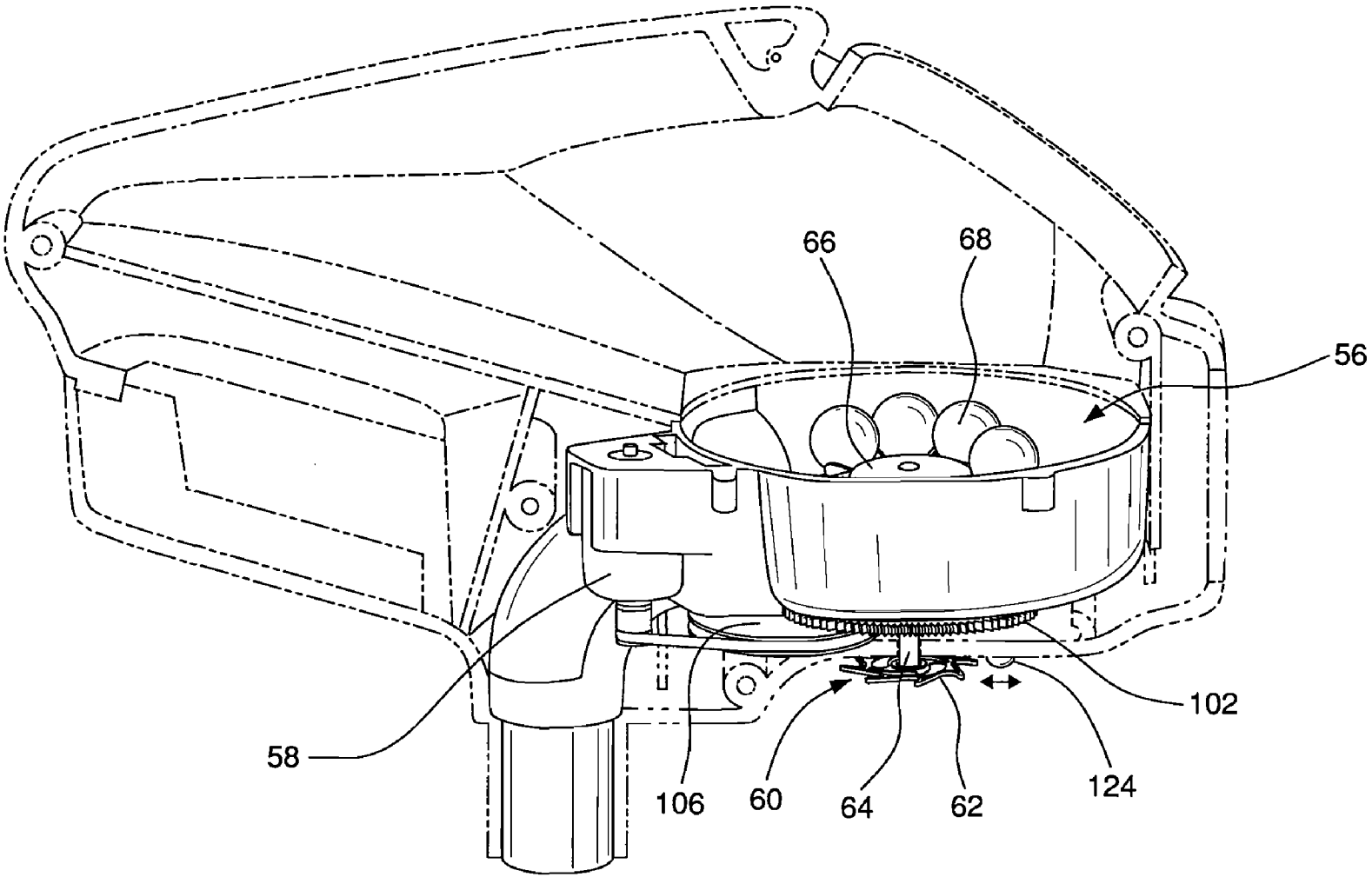
FIG. 3 is a partial top view of the active feed paintball loader of FIG. 2.
Figure 4:
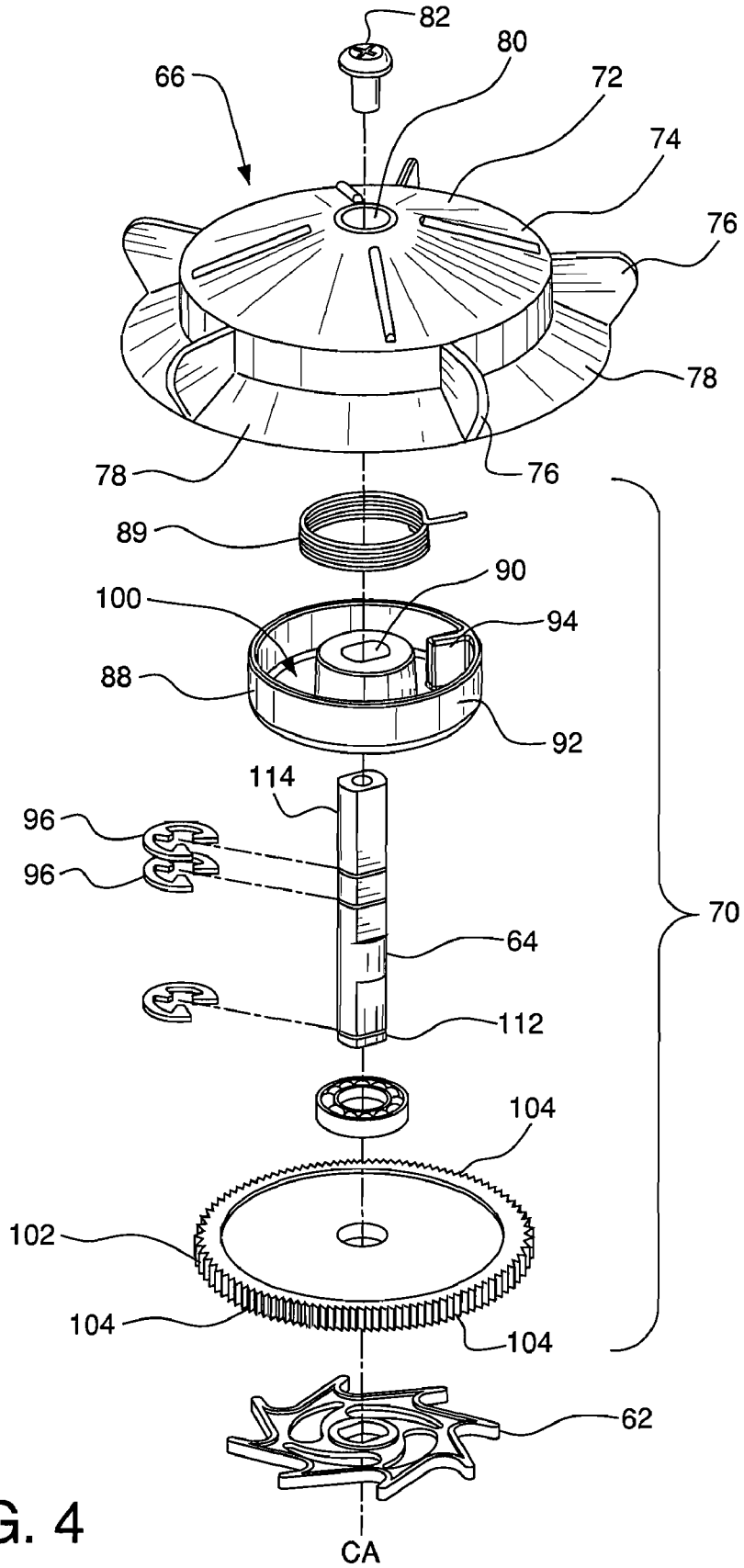
FIG. 4 is an exploded top perspective view of the feeder of FIG. 2.
Figure 5:
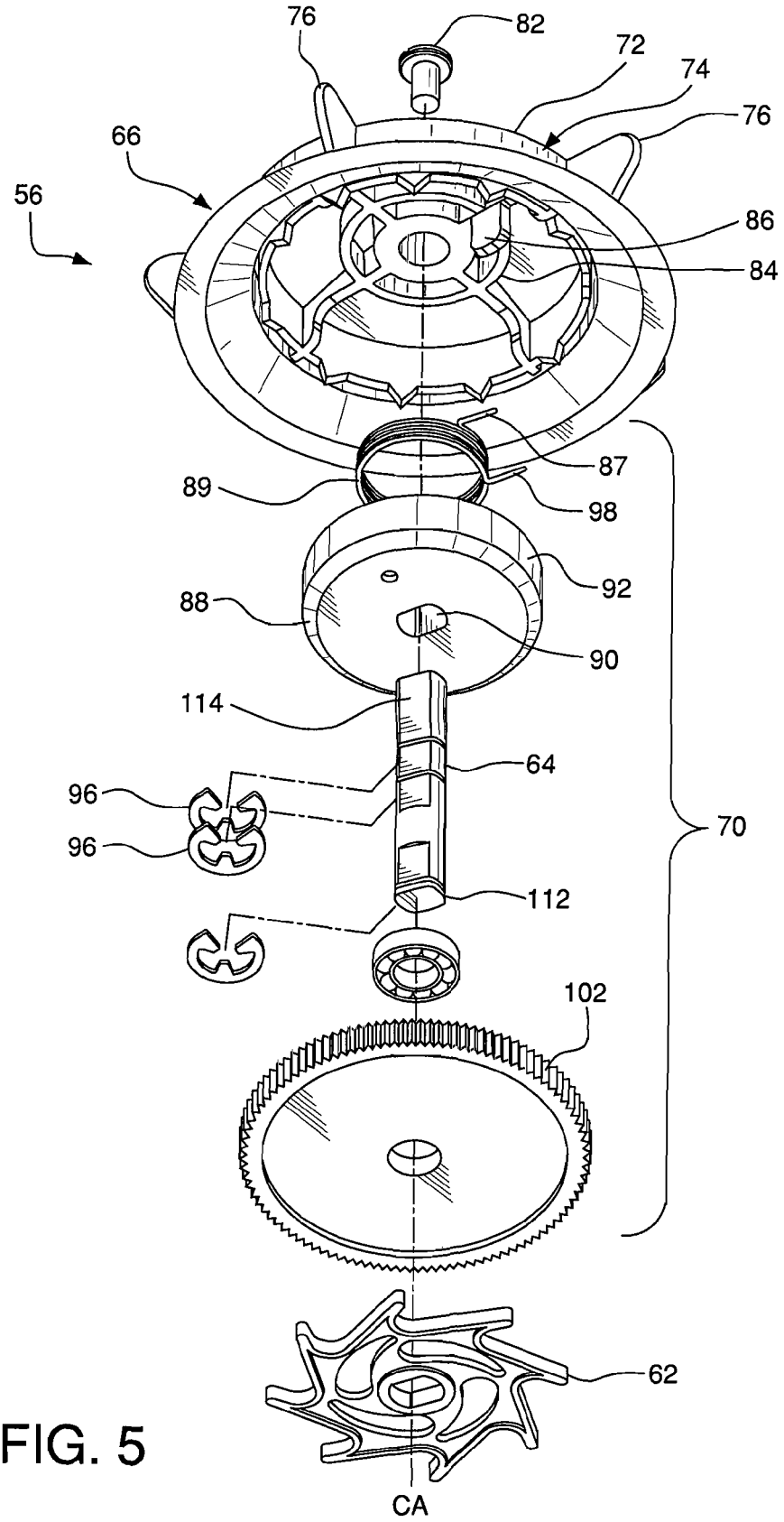
FIG. 5 is an exploded bottom perspective view of the feeder of FIG. 2.

Referring to FIGS. 3-5, the operation of the feed mechanism 56 will be explained. While a preferred feed mechanism 56 is shown, various other components may be substituted for driving paintballs into the paintball marker 20. The feed mechanism 56 includes a feeder 66 or other agitating device to drive, force or urge paintballs 68 into the exit tube 52, and a drive mechanism 70.

A variety of feeders 66 can be used in the present invention, including an impeller, drive cone, paddle wheel, fin, carrier or other device which can direct or otherwise force or urge paintballs into the exit tube 52. By way of example and not limitation, a drive cone 72 is shown in the Figures, and includes a housing 74 with a plurality of fins 76 which preferably extend in a radial direction from the housing 74. The drive cone 72 also preferably includes flanges 78 that extend between adjacent fins 76. The flanges 78 of the drive cone 72 provide at least some support from beneath a paintball adjacent the drive cone. While fins 76 are shown, it is appreciated that the feeder 66 may include recesses or pockets within which the paintballs 68 sit as they are shuttled toward the exit tube 52. A cylindrical opening 80 is formed in the center of the housing 74 for receiving a fastener 82. The fastener 82 is used to couple, engage or mount the feeder 66 to a drive shaft 64.

As shown in FIGS. 4 and 5, the feeder 66 is mounted on the extended drive shaft 64. The extended drive shaft 64 is connected to the motor 58 to rotate about a central axis CA. As the motor 58 operates, the feeder 66 turns, forcing balls into exit tube 52. Thus, when the motor 58 is in operation, a relatively constant pressure is applied to the paintballs 68 in the exit tube 52, as will be discussed in more detail below.

In some active feed loaders, a spring may connect the drive shaft 64 and the drive cone 72, such as in U.S. Pat. No. 6,701,907 ("Spring Loaded Feed Mechanism For Paintball Loader"), incorporated herein by reference. A similar embodiment is disclosed with respect to FIGS. 4 and 5, herein. Referring to FIG. 5, the bottom of the feeder 66 is shown in detail. The housing 74 includes an inner spool 84 having a retaining wall 86 affixed thereto. The retaining wall 86 is designed to engage a first end 87 of a spring 89, which will be discussed below.

As shown in FIGS. 4 and 5, a spring housing 88 is secured to the drive shaft 66. The spring housing 88 is disposed about the extended drive shaft 64 and positioned so as to be below the feeder 66. The spring housing 88 includes a central opening 90 and an outer wall 92 having a pressure wall 94 affixed thereto. The pressure wall 94 is designed to engage a second end 98 of the spring 89. The drive shaft 64 is designed to pass through the central opening 90 and secure the spring housing 88 such that rotation of the drive shaft 64 produces concomitant rotation of the spring housing 88. In the illustrated embodiment, a portion of the drive shaft 64 is shown non-cylindrical in shape and the opening 90 is formed with a mating non-cylindrical shape so that spring housing 88 is turned in coordination with the drive shaft 64. One or more fastening devices 96 such as an E clip can be used to restrain vertical movement of the spring housing 88 on the drive shaft 64.

Figure 6:
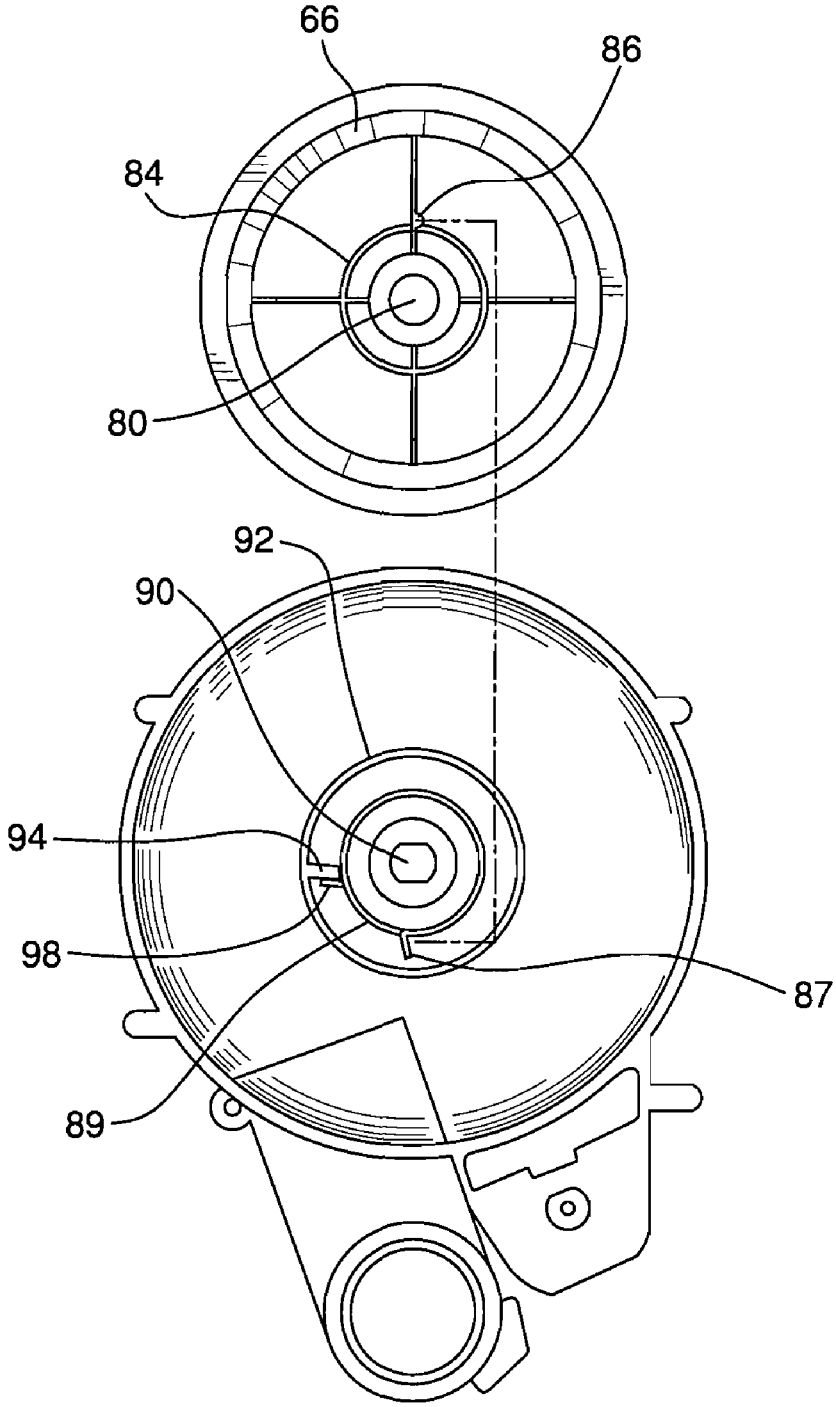
FIG. 6 is a plan view of the inner spool of the feeder shown disengaged from the outer wall of the spring housing and spring and showing the position of engagement between the spring and inner spool in dashed lines.

The inner spool 84 and outer wall 92 define a spring chamber 100 for spring 89 to be positioned. Although a spring is shown in the figures, other biasing members, such as elastomers can be used. As shown in FIGS. 4 and 5, the spring 89 is a torsion spring, however, other suitable springs can be used, such as a coil spring, compression spring, spiral spring, without limitation. One having ordinary skill in the art would appreciate that any type of suitable spring can be used in accordance with this invention. As shown in FIG. 6, the spring 89 is mounted so as to bias the feeder 66 against rotation relative to the spring housing 88. Rotation of the spring housing 88 about the central axis CA relative to the feeder 66 causes the spring 89 to wind.

Still with reference to FIGS. 4 and 5, the drive shaft 64 projects downward from the spring housing 88 and is adapted to engage a drive member 102 that is part of the drive mechanism 70. In the embodiment shown in FIGS. 2, 3, 4 and 5, the drive member 102 is a gear having a plurality of spaced apart gear teeth 104. The gear teeth 104 are adapted to engage with mating teeth on a second gear 106 having a drive belt 107 connected to the motor 58. While the drive member 102 in the illustrated embodiment is a gear, other types of conventional drive members can be used to produce controlled rotation, such as a pulley mechanism or stepper motor.

Figure 7:
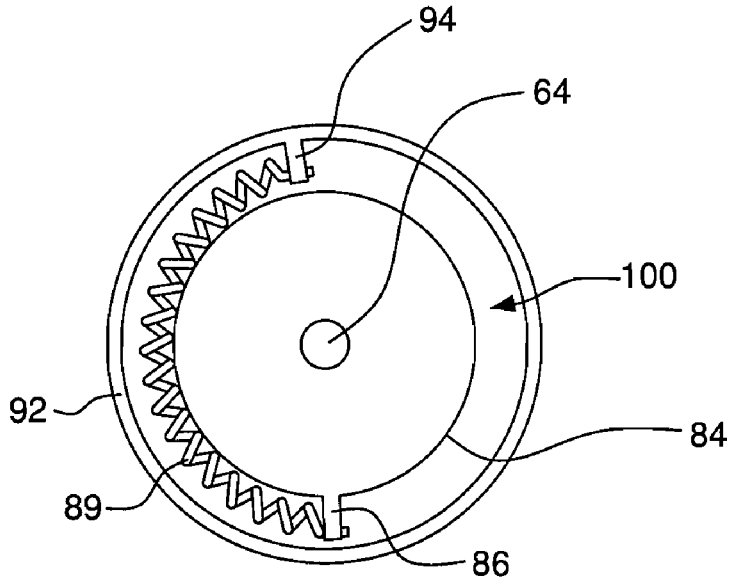
FIG. 7 is a top cross-sectional view of the feeder and spring housing utilizing a compression spring in an alternate embodiment.
Figure 8:
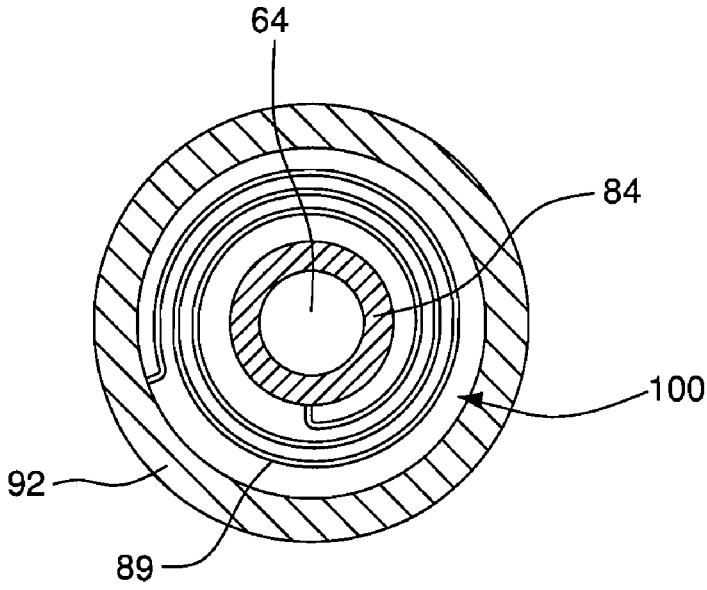
FIG. 8 is a top cross-sectional view of the feeder and spring housing utilizing a coil spring in an alternate embodiment.

It will be appreciated that the above embodiment of the drive mechanism 70 is a preferred embodiment only, and that other drive suitable drive mechanisms may be used. For example, as shown in FIGS. 7 and 8, the drive shaft 64 can be coupled directly to the motor 58. The drive shaft 64 winds a spring 89 to rotate the feeder 66 in a similar manner as described above. In the embodiment illustrated in FIG. 7, the spring 89 is a compression spring having a first end 87 engaged to the retaining wall 86 of the inner spool 84 and a second end 98 engaged to the pressure wall 94 of the spring housing 88. In the embodiment shown in FIG. 8, the spring 89 is a coil spring having a first end 87 directly connected to the inner spool 84 of the feeder 66 and a second end 98 directly connected to the outer wall 92 of the spring housing 88.

The operation of the feeder as set forth in the embodiment of FIGS. 4 and 5 is similar to that set forth in U.S. Pat. No. 6,701,907 ("Spring Loaded Feed Mechanism For Paintball Loader"), which is incorporated herein by reference. During operation of the drive mechanism 70, the motor 58 rotates the drive shaft 64, in this case in a counter-clockwise direction looking at the loader 10 from above, which in turn winds the spring 89. As spring 89 is wound it exerts a rotational force on the feeder 66 in a feeding direction, which in this case is counter-clockwise. Winding the spring 89 refers to increasing tension on the spring 89 to exert force on the feeder 66 so that releasing the tension on the spring 89 causes the feeder 66 to rotate in the feeding direction.

The interior area 46 of the container wall 44 stores a plurality of paintballs 68 prior to being discharged from the paintball marker 20 when the paintball marker 20 is fired. As the drive shaft 64 continues to rotate, individual paintballs 68 are moved along flanges 78 of feeder 66 toward the exit tube 52. Once a paintball 68 enters the firing chamber of the paintball marker 20 through the inlet tube 32, the paintballs 68 are maintained in a paintball stack in the exit tube 52 of the loader 10. Once a paintball stack is present in the exit tube 52, the back up of paintballs 68 prevents the feeder 66 from further rotation in the feeding direction. A paintball stack, as used herein, is defined as a line of paintballs maintained in a row, forced by an amount of tension from the drive spring 89 toward the exit tube 52 of the paintball loader 10 or inlet tube 32 of a paintball marker 20 attached to the loader 10. Although the feeder 66 is prevented from moving, the drive shaft 64 continues to rotate as previously discussed. When the feeder 66 is stationary, the further rotation of the drive shaft 64 causes the drive shaft 64 to wind the drive spring 89. This provides a constant tension on the paintball stack.

Figure 2:
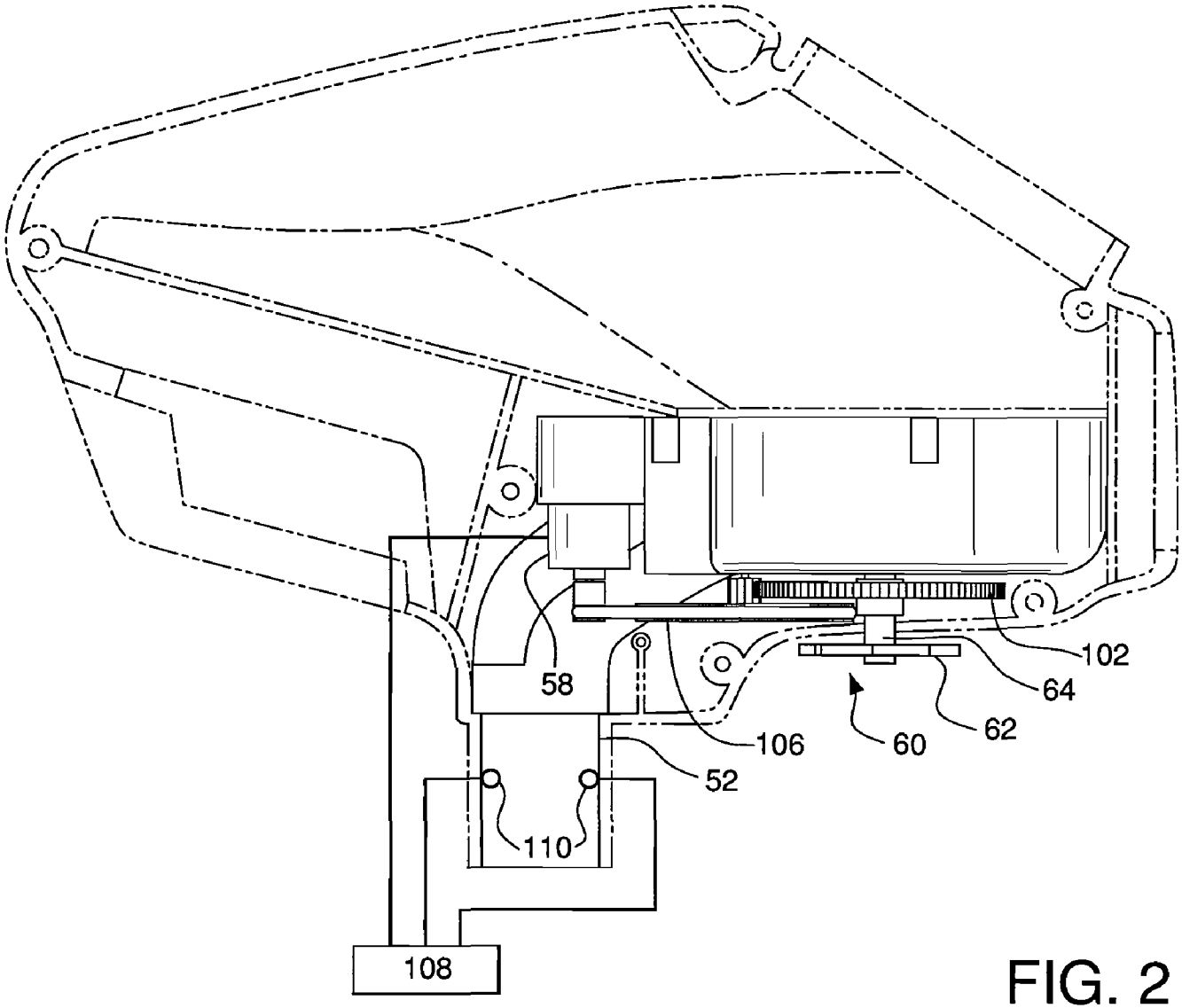
FIG. 2 is side cut-away view of the active feed paintball loader of FIG. 1 illustrating the loader housing in phantom.

Referring to FIG. 2, a microprocessor 108 connected to at least one sensor 110 (two sensors are illustrated FIG. 2) can also be used in conjunction with the loader 10 of the present invention to deactivate the drive motor 58 when the exit tube 52 is full. The sensors 110 are preferably positioned in the exit tube 52 of the paintball loader 10 to detect either the presence or absence of paintballs within the exit tube 52 and relay that information to the microprocessor 108 for controlling operation of the motor 58. It should be appreciated that the sensors can be positioned in other areas such as the inlet tube 32, the firing chamber, etc. The microprocessor 108 is in communication with the motor 58. When the sensor 110 detects either the presence or absence of paintballs within the exit tube 52, the microprocessor 108 receives a signal. If paintballs are present in the exit tube 52, the microprocessor 108 may send a signal to turn the motor 58 off. When the sensor 110 does not detect any paintballs within the exit tube 52, the microprocessor 108 can then signal the motor 58 to turn on and rotate the feeder 66, providing additional paintballs to the inlet tube 32 of the paintball marker 20. It should be understood that any acceptable sensors may be utilized to detect paintballs, such as optical or infrared sensors, a contact pad, an actuator switch, etc., without departing from the scope of the present invention.

In an alternative embodiment, a microprocessor can be used to turn off the motor 58 based on the anti-rotational force exerted on the motor 58. As the spring 89 is wound, the torque required for further rotation of the drive shaft 64 increases until the amount of torque required to further wind the drive spring 89 exceeds the capability of the motor 58, causing the motor 58 to stall. As the motor 58 begins to slow down and eventually stall, the current flowing through the motor 58 exceeds the upper limit, such that the microprocessor causes the motor 58 to turn off. In this manner, the micrcoprocessor controls the amount of stored energy in the drive spring 89.

Figure 9:
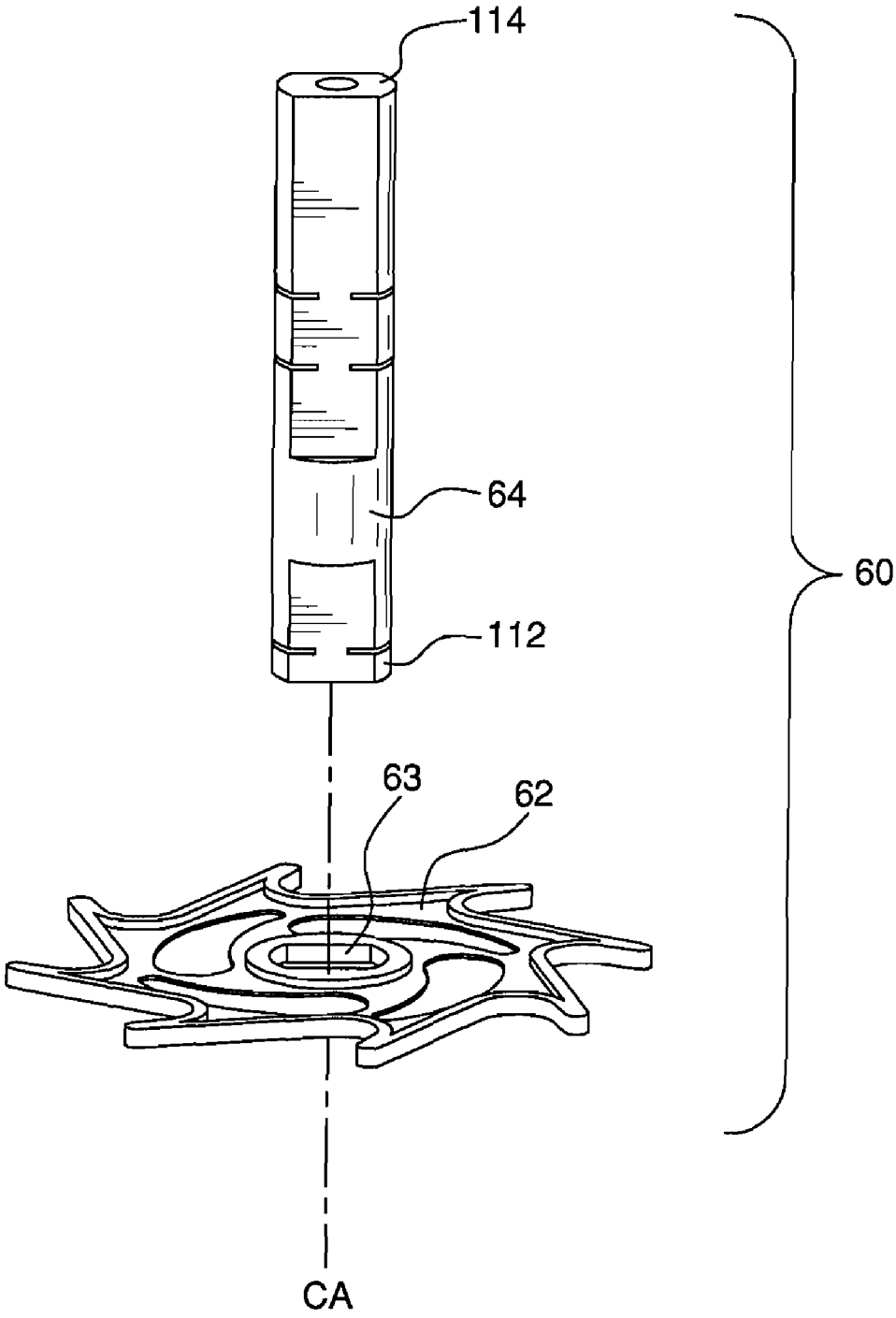
FIG. 9 is an exploded view of the drive shaft and handle of FIG. 3.

The extended drive shaft 64 of the present invention is provided to have at least a lower portion 112 extending through the lower portion 50 of the container wall 44 for external access. It should be appreciated that the extended drive shaft 22 may extend through either the bottom or top of the loader 10, depending on the desired configuration. An upper portion 114 of the drive shaft 64 is mechanically connected to (or formed integral with) the feeder 66 or other agitating device employed by the active feed loader 10. A handle 62 is attached to the lower portion 112 of the extended drive shaft 64 on the external side of the container wall 44 of the loader 10, so that it can be accessed by a user. In the illustrated embodiment, a portion of the drive shaft 64 is shown non-cylindrical in shape to mate with a non-cylindrical opening 63 formed on the handle 62 so that drive shaft 62 is turned in coordination with the handle 62. The handle 62 may take the form of a crank handle having a plurality of circumferentially projecting teeth 115 as shown in FIGS. 4, 5, and 9. Turning the handle 62 will turn the drive shaft 64 and, thus the feeder 66. Because of the spring 89 located at a position between the drive shaft 64 and the feeder 66, the drive shaft 64 is free to move. Hence, if a jam occurs, turning the handle 62 in a direction opposite the feeding direction will relieve pressure on the paintball stack, and the loader 10 may be manipulated to release a jammed paintball. Releasing the handle 62 will allow the spring 89 to again bias the feeder 66 in the feeding direction, thereby urging paintballs into the exit tube 52.

In addition to assisting the operation of the active feed loader 10 when a jam occurs, the present invention may also provide a means for mechanically operating the loader 10 if the power source of the loader 10 is disconnected or drained of power. As previously discussed, the loader 10 is equipped with a spring 89 held within a spring chamber 100 and disposed between the drive shaft 64 and the feeder 66 for biasing the feeder 66 in the direction of the rotation of the feeder 66 when operated by the motor 58. The handle 62 is mounted to the drive shaft 64 as described above. Manually turning the drive shaft 64 in a counter-clockwise direction will cause a winding of the spring 89. This creates tension between the spring 89 and the drive cone 72. Paintballs 68 will drop into the gap between the fins 76 of the drive cone 72. When the handle 62 is released, the spring 89 will unwind, causing the drive cone 72 to turn and, accordingly, feeding of the paintballs 68 into the exit tube 52 of the loader 10 for firing by the paintball marker 20. Hence, in this embodiment, if a power source such as a battery powering the motor 58 of the active feed loader 10 loses power, a paintball sport player can turn handle 62 to wind the spring 89 and still shoot several paintballs.

Figure 10:
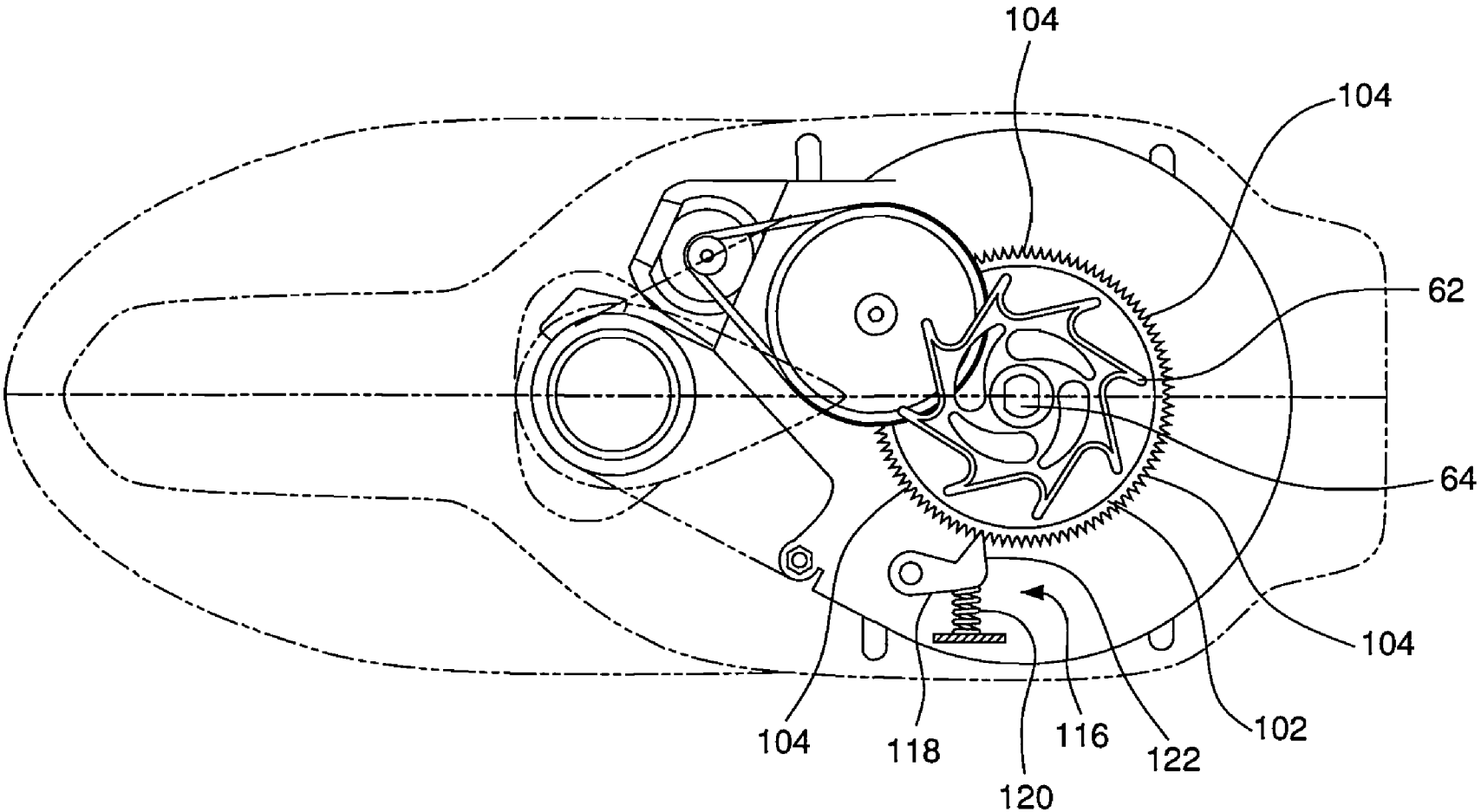
FIG. 10 is a bottom plan view of the drive member and ratchet system illustrating the loader housing in phantom.

A ratchet system 116 as shown in FIG. 10 comprising a ratchet wheel and pawl 118, may also be employed to store potential rotatational energy upon winding spring 89. In the embodiment shown in FIG. 10, drive member 102 can be used as a ratchet wheel. However, it should be appreciated that a ratchet wheel can be separately mounted to the drive shaft 64 apart from drive member 102. A pawl 118 is preferably pivotally secured within the interior area 46 of the container 42 to engage the spaced apart teeth 104 of the gear 102. A spring 120 is preferably provided to bias a head 122 of the pawl 118 into engagement with the spaced apart teeth 104. The handle 62 can be used as described above to wind spring 89 to manually rotate the feeder 66. As the handle 62 is turned, the pawl 118 ratchets with the teeth 104 of the gear 102, thereby preventing unwinding of spring 89 and storage of the spring's energy. A means for disengaging the pawl 118 from the teeth 104 is provided, such as a switch accessible on the external side of the container wall 44, for moving the pawl 118 out of engagement from the teeth 104. However, it should be appreciated that any means adapted to disengage the pawl 118 from the teeth 104 may be used.

When the pawl 118 is disengaged from the teeth 104, the energy stored during winding of the spring 89 is released, and thus, the feeder 66 may rotate to urge paintballs 68 into the exit tube 52 of the loader 10. The spring energy provides short bursts of firing, far beyond the firing rates available for a loader limited to "shake and shoot."

In the embodiment illustrated in FIG. 3, a biasing member 124 extending from the lower container wall 44 can be removable engaged to the handle 62 to store potential rotatational energy upon winding spring 89. As shown in FIG. 3, the biasing member 124 can be moved into engagement with the teeth 115 of the handle 62 upon winding of spring 89, and removed from engagement to allow the spring 89 to unwind to rotate the feeder 66 in the same manner as discussed above.

A pull cord mechanism can also be used in accordance with the present invention to assist the winding of spring 89. In this embodiment, a cord, string or other flexible material is preferably secured at a first end to one of the drive shaft 64, drive member 102, or spring housing 88. A second end of the cord is preferably exposed through the exterior of the container wall 44 to permit user accessibility. When the spring 89 is in a resting state, the cord is wound within the interior area 46 of the container 42. When a user pulls the cord, spring 89 is wound, storing energy in the spring 89. When the cord is released, energy in the spring 89 causes the feeder 66 to rotate in the same manner as discussed above. Unwinding of spring 89 simultaneously causes the cord to retract back into the interior area 46 of the container 42. Hence, in this embodiment, if a power source such as a battery powering the motor 58 of the active feed loader 10 loses power, a paintball sport player can operate the cord to wind the spring 89 and still shoot several paintballs.

A rack and pinion type actuator can also be used in accordance with the present invention to assist the winding of spring 89. In this embodiment, a rack having a plurality of teeth is spring biased within the interior area 46 of the container 42. The teeth of the rack mesh with complimentary teeth of a gear secured to the drive shaft 64. Drive member 102 may be used to engage the rack. As the rack is moved in a linear direction, it preferably causes the gear to rotate in the feeding direction, thus, rotating the drive shaft 64 and winding the spring 89. The rack can have a portion that extends externally from the loader 10 or can be connected to a handle or lever that extends externally from the loader 10 so that a user may move the rack to wind spring 89. Hence, in this embodiment, if a power source such as a battery powering the motor 58 of the active feed loader 10 loses power, a paintball sport player can operate the rack to wind the spring 89 and still shoot several paintballs.

While various methods, configurations, and features of the present invention have been described above and shown in the drawings for the various embodiments of the present invention, those of ordinary skill in the art will appreciate from this disclosure that any combination of the above features can be used without departing from the scope of the present invention. Accordingly, it is recognized by those skilled in the art that changes may be made to the above described methods and embodiments of the invention without departing from the broad inventive concept thereof. It is understood, therefore, that this invention is not limited to the particular methods and embodiments disclosed, but is intended to cover all modifications which are within the spirit and scope of the invention as defined by the appended claims and/or shown in the attached drawings.

What is claimed is:

1. A drive assist mechanism for use with an active feed paintball loader comprising:

a drive shaft longitudinally positioned along a center axis and rotatable about the center axis;

a drive member mounted on the drive shaft and rotatable about the center axis in coordination with the drive shaft;

a feeder secured to the drive shaft and independently rotatable about the center axis relative to the drive member;

a spring located between the drive member and the feeder, the spring adapted to maintain constant tension on the feeder when the drive shaft rotates in a feeding direction; and a manual drive handle secured to the drive shaft and extending externally from the loader, the manual drive handle being rotatable about the center axis in coordination with the drive shaft.

2. The drive assist mechanism of claim 1, wherein the feeder is a drive cone.

3. The drive assist mechanism of claim 1, further comprising a motor coupled to the drive shaft for rotating the drive shaft about the center axis.

4. The drive assist mechanism of claim 3, further comprising a microprocessor in communication with the motor, the microprocessor adapted to control operation of the motor.

5. The drive assist mechanism of claim 1, wherein the drive member has a plurality of circumferential teeth and a pawl is adapted to removably engage the teeth to fix the position of the drive member.

6. The drive assist mechanism of claim 1, further comprising a ratchet wheel secured to the drive shaft and having a plurality of circumferential teeth, and a pawl adapted to removably engage the teeth to fix the position of the drive shaft.

7. The drive assist mechanism of claim 1, wherein the spring is one of a torsion spring, spiral spring, compression spring and coil spring.

8. The drive assist mechanism of claim 1, further comprising:

a spring housing secured to the drive shaft to rotate in coordination with the drive shaft, the spring housing being positioned beneath the feeder to form an enclosed chamber with the feeder to house the spring;

wherein the spring housing includes a pressure wall and the feeder includes a retaining wall, wherein the spring is wound by the pressure wall and retaining wall when the manual drive handle is rotated in the feeding direction.

9. An active feed paintball loader for use on a paintball marker, the paintball loader comprising:

a loader housing for holding a plurality of paintballs;

a drive assist mechanism for feeding paintballs into an inlet of a chamber of the marker comprising:

a drive shaft longitudinally positioned along a center axis and rotatable about the center axis;

a feeder independently rotatable about the center axis relative to the drive shaft;

a spring having a first end engaged to the drive shaft and a second end engaged to the feeder, the spring adapted to maintain constant tension on the feeder when the drive shaft rotates about the center axis in a feeding direction; and a manual drive handle secured to the drive shaft and positioned to extend externally from the loader housing, the manual drive handle being rotatable about the center axis in coordination with the drive shaft.

10. The active feed paintball loader of claim 9, wherein a securing member is adapted to removably engage the mechanical drive handle to secure the drive spring in a wound condition.

11. A manual agitator for an active feed paintball loader comprising:

a drive shaft longitudinally positioned along a center axis and rotatable about the center axis;

a drive member mounted on the drive shaft and rotatable about the center axis in coordination with the drive shaft;

a feeder secured to the drive shaft and independently rotatable about the center axis relative to the drive member;

a manual drive handle secured to the drive shaft and positioned to extend externally from the loader, the manual drive handle being rotatable about the center axis in coordination with the drive shaft.

12. An active feed paintball loader for actively maintaining a paintball stack, comprising:

a drive shaft;

a feeder rotatable about the drive shaft and providing support beneath at least one paintball in the paintball stack;

a motor in communication with the drive shaft for rotating the drive shaft in a feeding direction, the motor being coupled to a microprocessor to control operation of the motor;

a spring positioned between the drive shaft and the feeder, the drive shaft winding the spring to maintain sufficient tension on the spring for maintaining the paintball stack; and a drive assist mechanism comprising a mechanical drive handle positioned adjacent an outer wall of the loader and accessible externally of the loader, the mechanical drive handle adapted to manually rotate the drive shaft.

* * * * *